US005367218A

United States Patent [19]

Comby

[11] Patent Number: 5,367,218

[45] Date of Patent: Nov. 22, 1994

[54] CERAMIC ELECTRON MULTIPLYING STRUCTURE, PARTICULARLY FOR A PHOTOMULTIPLIER AND ITS PRODUCTION PROCESS

[75] Inventor: Georges Comby, Rambouillet, France

[73] Assignee: Commissariet a l'Energie Atomique, Paris, France

[21] Appl. No.: 887,352

[22] Filed: May 21, 1992

[30] Foreign Application Priority Data

May 21, 1991 [FR] France ..... 91 06099

[51] Int. Cl.[5] ..... H01J 43/00; H01J 43/20

[52] U.S. Cl. ..... 313/105 CM; 313/103 CM; 313/105 R; 445/23; 445/47; 445/50; 445/51

[58] Field of Search ..... 313/103 R, 103 CM, 104, 313/105 R, 105 CM, 634; 250/207; 445/22, 23, 29, 33, 35, 43, 47, 50, 51

[56] References Cited

U.S. PATENT DOCUMENTS

| | | | |
|---|---|---|---|
| 3,197,663 | 7/1965 | Norman et al. | 313/103 CM |
| 3,564,328 | 2/1971 | Bagley | 313/634 |
| 3,673,449 | 6/1972 | Eschard | 313/105 |
| 4,482,836 | 11/1984 | Washington et al. | 313/104 |
| 4,652,788 | 3/1987 | Lauche et al. | 313/103 R |
| 4,825,118 | 4/1989 | Kyushima | 313/103 CM |

FOREIGN PATENT DOCUMENTS

| | | | |
|---|---|---|---|
| 0283773 | 9/1988 | European Pat. Off. . | |
| 0401879 | 12/1990 | European Pat. Off. . | |
| 0413481 | 2/1991 | European Pat. Off. . | |
| 2107436 | 4/1990 | Japan . | |
| 1061190 | 12/1983 | U.S.S.R. | 313/105 CM |

OTHER PUBLICATIONS

Bruce E. Woodgate; "Multiple-Dynode-Layer Microchannel Plate" (Licensing Opportunity BRIEF) 2301 NTIS Tech Notes (1990) Oct. Springfield, Va., US.

*Primary Examiner*—Donald J. Yusko
*Assistant Examiner*—N. D. Patel

[57] ABSTRACT

The present invention relates to a multiplier structure having a very compact shape and which can have the output electrodes of the channels arranged in any random direction. The multiplying structure (94) is a ceramic block obtained by baking a stack of ceramic sheets prepared beforehand with a view to forming cavities includes in the mass. Each cavity (21) is covered by a metal deposit connected to a lateral contact (23) by a conductor (24) printed beforehand on the corresponding sheet. The channels can have special geometries in order to have their output on several different surfaces (41, 46, 47) of the multiplying structure.

9 Claims, 4 Drawing Sheets

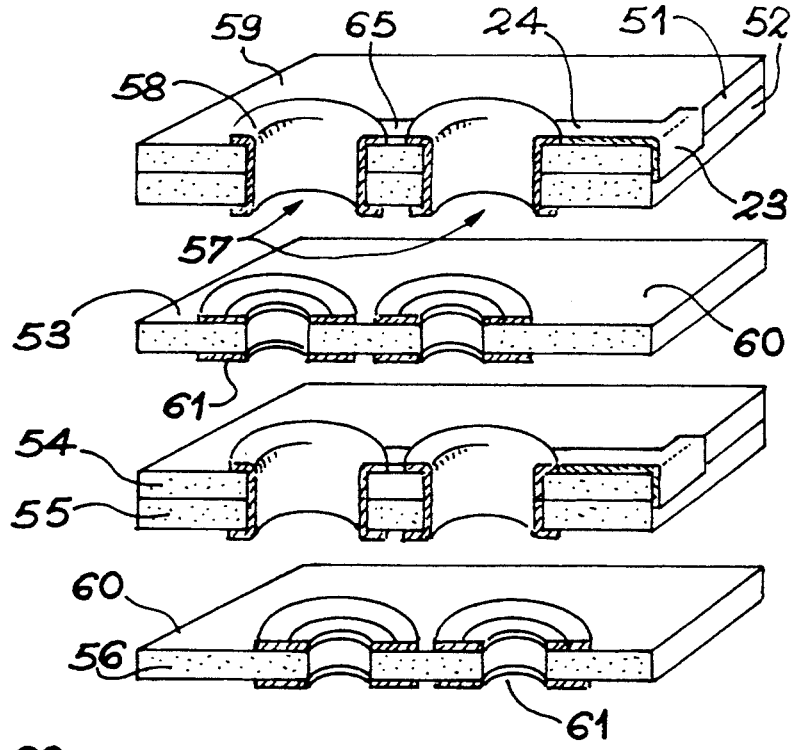
FIG. 13
FIG. 14
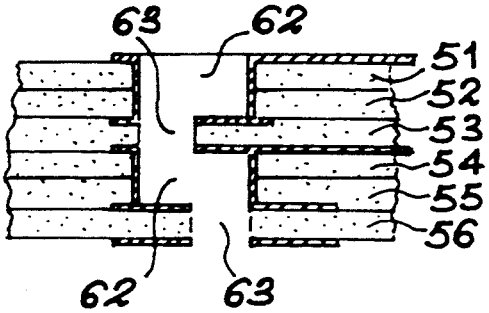
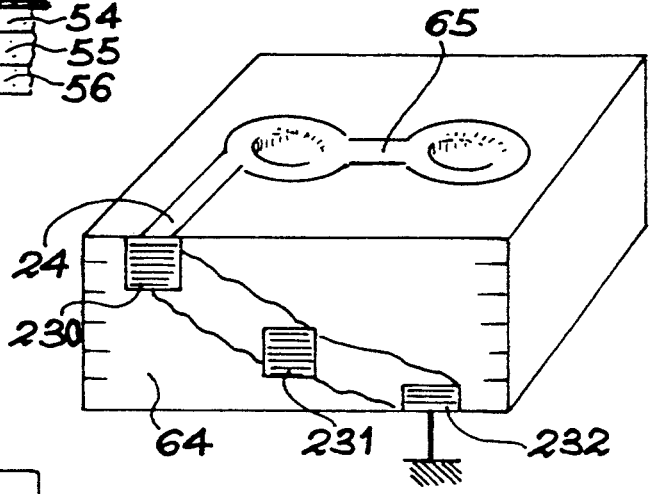
FIG. 15
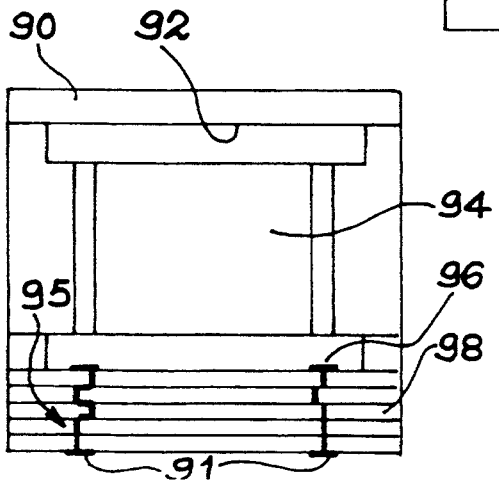
FIG. 16

CERAMIC ELECTRON MULTIPLYING STRUCTURE, PARTICULARLY FOR A PHOTOMULTIPLIER AND ITS PRODUCTION PROCESS

FIELD OF THE INVENTION

The invention relates to electron multipliers having a large number of independent electron multiplication channels. The invention also relates to the devices resulting from the association of such multichannel multipliers with various electron sources positioned upstream and electron-multiplied active or passive flux receivers downstream. The invention also relates to the production of such multipliers.

PRIOR ART

Despite the appearance on the market of numerous very sensitive detectors, the detection of a single low energy electron (qq ev) requires an electron multiplication in order to obtain an adequate electric charge to be detected. The electron multiplier fulfils an essential function in a known component constituted by the photomultiplier, but its use would not be limited to this application.

However, it is through this application that we will stress the inadequacies and inconveniences of existing multi-channel photomultipliers in order to justify the proposals made in the invention and demonstrate the advantages resulting therefrom.

This particular application of electron photomultipliers is that of associating therewith a primary electron source photocathode and a base carrying electrodes in order to extract the signals and polarize the stages, so as to create a photomultiplier. At present, no matter which manufacturer is involved, the manufacture of these photodetectors is based on the technology of lamps with work carried out by the glassmaker where, in most cases, the shield window (photocathode support), as well as the base form an integral part of the envelope. Consequently, the geometry and connections of such tubes do not permit effective groupings with a view to forming large homogeneous photosensitive sources (qq $m^2$). This constitutes a severe limitation with respect to their use in all fields of living and material sciences in the industrial world.

A brief description will not be given of the principle of operation of an electron multiplier, no matter whether it is of the monochannel or multichannel type. FIG. 1 shows the main components making it possible to explain this procedure. Reference 1 symbolizes a vacuum enclosure containing the other components. The multiplication electrodes E 1, 2, 3, 4 have a shape and spatial arrangement appropriate for collecting and reemitting electrons. They are electrically insulated from one another and communicate with the exterior by pins fixed to the envelope by means of insulating passages. The output electrode or anode 5 results from the same technology. Each electrode is covered with a layer favouring secondary emission. The electrode 3 will supply the primary electrons necessary for triggering the multiplication and here serves as the cathode. The distribution of the potentials is established in order to apply an electric field between the electrodes. The anode is connected to earth or ground across a measuring instrument.

An electron emitted by 3 is accelerated by the electric field prevailing between 3 and $E_1$ and then impacts the latter, which in turn emits N electrons, which are themselves accelerated to impact $E_2$. The procedure continues and 5 intercepts a flux of $N^4$ electrons.

As has been proposed by certain authors, of FIG. 2, it is possible in this way to form a series of vertically oriented channels 86 therein. They are constituted by a series of cavities 88 having the properties mentioned in the previous paragraph. These channels result from a stack of metal plates 80, 82, 84, in which have been formed the cavities 88. These cavity-containing metal plates, called perforated plates, are insulated by plates or insulating crosspieces. Therefore with a stack it is possible to form a perforated plate multiplier, as shown in FIG. 3.

It is described in an article by J. P. BOUTOT, P. LAVOUTE and G. ESCHARD, "Multianodes, photomultiplier for detection and localization of low light levels events", IEEE, France, Nucl. Sci., no. 34, 1987, p. 449.

It comprises an entrance window 2, generally made from glass, which enables the photons to reach a photocathode 4 deposited on the inner face of said window 2. One or two grids 6 placed below the photocathode 4 impose an electrostatic distribution of field lines joining the photocathode 4 to the multiplying structure with a view to defining a given number of pixels, in this case 64. Below the grid 6 is located the stack formed from the different perforated plates 8 fulfilling the multiplication function. The stack of perforated plates 8 is terminated by an output electrode 10 subdivided into 64 output electrodes connected to the outside by pins 14. These electrodes 10 are placed on an output plate 12, often made from glass and collect the electric signals having an amplitude proportional to incident photon fluxes to which each of the pixels is exposed. The assembly of multiplying plates 80 is placed under a vacuum in an enclosure defined by the input 4 and output 12 plates and by the walls 16.

It should be noted that the diagram of FIG. 3 extracted from the aforementioned publication, the pins ensuring the polarization of the different multiplying stages are not shown.

FIGS. 4 and 5 show a convention photomultiplier.

It is firstly possible to see the cumbersome shape of the tight enclosure defined by the walls 16, compared with the size of the active zone, i.e., 64 pixels. This is increased by the existence of an exhaust tube 17 projecting over the walls 16. Moreover, these multiplying plates 8 are polarized by peripheral pins 18 placed around the stack and projecting beyond the output plate 12.

This photodetector suffers from the following disadvantages:

- the ratio of the photosensitive surface to the overall dimensions is approximately 13% , which is inadequate;
- the shape is made more complicated by the existence of the exhaust tube 17, which reduces to less than 10% the geometrical efficiency of this component in the case of the juxtaposing of several tubes;
- its use imposes the cabling of a special, large and costly base for distributing the polarization of the different stages;
- the pins of the output signals and the high voltage pins for polarizing the stages skirt the same face of the tube;

the difficulty of extracting with short connections the signals from 64 pins located in the central zone;

the difficulty of obtaining for the same tube a homogeneous multiplication of the 64 channels and, within a series of tubes, a uniformity between individuals (as was shown by operating tests);

the difficulty of increasing the tube size with a view to increasing the number of pixels (256 or 1024);

the difficulty of obtaining the desired photocathode type with reasonable costs and time delays;

the difficulty of obtaining the desired entrance window type on the part of manufacturers; and finally the impossibility for the user of inserting the multiplier alone in an experimental chain between an initial particle generator, which would replace the photocathode and a special device for analyzing the output electron fluxes.

All these disadvantages do not result from the shapes, sizes and positions of the multiplying zones, or even the nature of the electrodes and the emissive deposits. They result from the very design of the multiplier, whose production and consequently operation make it necessary for it to be placed in a vacuum enclosure, which is here made from glass. Continuing the analysis of this particular application for the production of photomultipliers, it can be seen that this glass technology involves the following stages:

the preparation of the mechanics of the multiplying structures by chemical etching, assembly of the multiplying stages, stacking the stages electrically insulated by glass balls and ceramic crosspieces;

the preparation of a base carrying pins used for polarizing the stages and extracting the signals and mechanically fixing the multiplier;

the preparation of a glass envelope connecting to the base the shielding window, which will form the future photocathode support;

the final phase where the assembly has to be pumped, placed in an oven and then sensitized by the production of the photocathode and the activation of dynodes. This activation phase must take place in a single operation which, if defective, leads to the recovery-preventing rejection of all the components involved. This leads to the production of small photomultipliers having planar stages.

All these disadvantages are not specific to the application used for analyzing and qualifying the prior art.

The object of the invention is therefore to obviate these disadvantages and to propose an electron multiplier autonomous with respect to vacuum, the mechanical aspect of the polarization of stages and the spatial distribution of the inputs/outputs of the multiplication channels.

To this end, the invention proposes producing a multiplier in the form of a self-supporting compact block, including in the mass all the components necessary for establishing the potentials and producing the secondary electrons necessary for the multiplication using multilayer ceramic technology. For more than 20 years multilayer ceramics have been subject to profound studies and an intensive industrialization and lead to inexpensive products having high physical, chemical. mechanical and geometrical performance characteristics. Moreover, the considerable variety of products, the precision of the dosing of the constituents and the informalization of production procedures widen the possibilities offered with a view to satisfying ever more complex constructional requirements.

Using the example of NTK (Japan) and XERAM (France), "cosintered" multilayer ceramic substrates are marketed as boxes or cases for housing integrated circuits or as printed circuits making it possible to install electronic components with a high density. This results from the large number of surface connections which can be made on each face of the ten, twenty or thirty ceramic sheets prior to baking. The product obtained as a result of the sintering operation has a very good sealing, indicating high reliability and long life, as well as a very dense surface and mass interconnection network connecting the electronic components positioned on the periphery.

The invention makes use of the technology of multilayer ceramics and adapts same with a view to producing a compact electron multiplier usable in numerous applications, including photomultipliers.

SUMMARY OF THE INVENTION

A first object of the invention is a compact secondary emission-based electron multiplying structure having a plurality of multiplying channels, characterized in that it is constituted by a tight, insulating, compact ceramic block, in which are distributed in three-dimensional form cavities having conductive walls formed from a conductive deposit, which are appropriately activated and interconnected by a connecting duct making possible the transit of the amplified electron flux, as well as polarization means for the cavities.

In its main realization, the multiplying structure according to the invention results from the high temperature sintering of a stack of crude ceramic plates or sheets, whereof each plate or sheet has previously been punched and machined in order to create connecting ducts and cavities. The polarization means are constituted by the metal deposit on the surface of cavities and conductive tracks on one surface of each ceramic plate for connecting each cavity to lateral electrical contacts.

To complete the description of this structure, it should be noted that the cavities can occupy any random position in the block, contrary to what is imposed by the stack of perforated metal plates. The procedure of "cosintering" insulating sheets offers a real three-dimensional distribution of the cavities and therefore the liberty of associating the cavities so as to form curved channels. The electrical independence of the cavities associated with the three-dimensional distribution makes it possible to produce curved channels (FIG. 7), where the electron fluxes arrive and leave on the same face of the block.

Several different reciprocal positions of the channels are possible. Thus, the channels can meet, communicate with one another, subdivide or regroup.

In a special construction of the channels, several successive cavities of the same channel can be polarized to the same voltage, whilst being connected to the same lateral contact, in order in this way to form the same multiplier stage. If the cavities are simply metallized, the structure can also be used as an electronic multilens with a view to conditioning the electrons in spatial and energy distributions.

A second main object of the invention is a photomultiplier having a multiplying structure of the type defined hereinbefore, and a photocathode located at the first end of each channel to receive the light pulses and transform them into electronic pulses in the said channels, at least one output electrode for sampling the amplified pulses and located at the second end of each channel and a base also formed from ceramic plates coated with appropriately arranged electroemissive conductive coatings.

A third object of the invention is a process for the production of a multiplying structure of the type defined hereinbefore. It comprises the stages of machining the crude ceramic plates or sheets for forming the cavities and intercavity channels, inking with conductive ink the zones where the cavities will be formed and the conductive tracks connecting them to one another and to a lateral external contact, stacking the thus prepared plates or sheets, baking under the requisite conditions, deposition on conductive zones of the cavities of material suitable for producing, after activation, a high secondary emission, deposition on the outer contacts of metals providing an excellent ohmic contact and activation of the multiplier by appropriate physicochemical processes.

LIST OF DRAWINGS

The problem which the invention aims at solving and the prior art multiplier have been described with the aid of the first drawings, which respectively show:

FIG. 1 The operating principle of an electron multiplier common to the prior art and the invention.

FIG. 2 This principle applied to multiple vertical channels.

FIG. 3 The operating diagram of a photomultiplier incorporating a prior art perforated sheet multiplier.

FIG. 4 Another prior art photomultiplier in plan view.

FIG. 5 The same photomultiplier seen from the side.

The invention and its technical characteristics will be better understood from the following detailed description and with reference to the attached drawings, wherein show:

FIG. 6 The constitution of a multiplication channel according to the invention without stipulating the shape of the cavities.

FIG. 7 A first possible configuration for a channel in a multiplying structure according to the invention.

FIG. 8 Another possible configuration in which the channel is subdivided into two channels in the structure according to the invention.

FIG. 9 A three-stage, two-channel multiplier.

FIG. 10 A possibility of associating three compact multipliers.

FIG. 11 An embodiment of the multiplying structure according to the invention.

FIG. 12 In section, the multiplying structure of FIG. 11.

FIG. 13 An embodiment of the ceramic sheets in the process according to the invention.

FIG. 14 An assembly example of the sheets of FIG. 13.

FIG. 15 The lateral face of a multiplying structure carrying the external contacts making it possible to polarize the cavities.

FIG. 16 An embodiment of the photomultiplier according to the invention.

DETAILED DESCRIPTION OF AN EMBODIMENT

Figure 6:
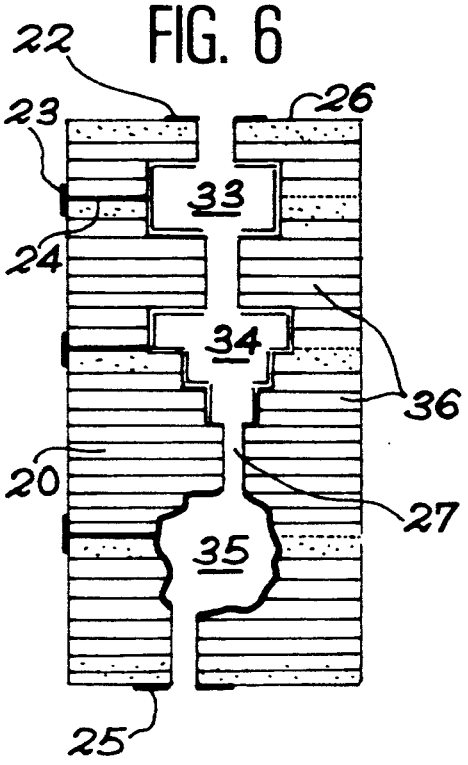

In the channel shown in FIG. 6, three cavity shapes are given in exemplified manner. The first cavity 33 is cylindrical. The second cavity 34 is a stack of hollow coaxial cylinders. The third cavity 35 has a random shape, which can be obtained in approximate manner by a stack of appropriately cut sheets.

These three examples of cavity shapes can be obtained by punching ceramic plates 36, which are then superimposed. Therefore a considerable freedom is offered for the positioning of the interconnection tracks on any random one of the sheets participating in the formation of a cavity.

Figure 1:
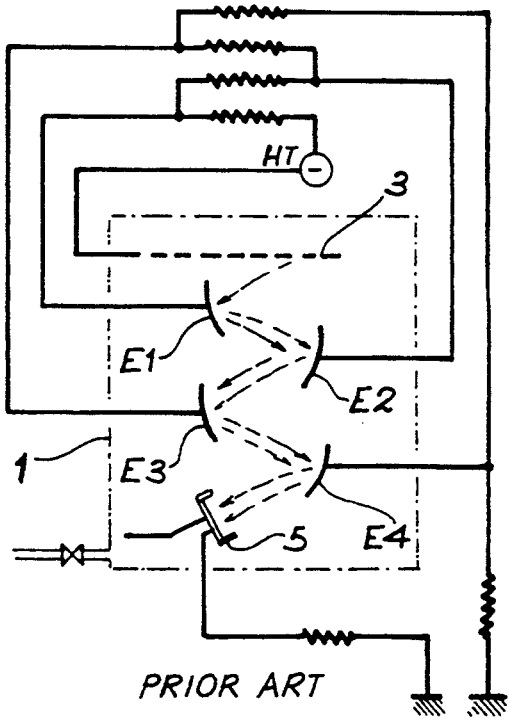
Figure 2:
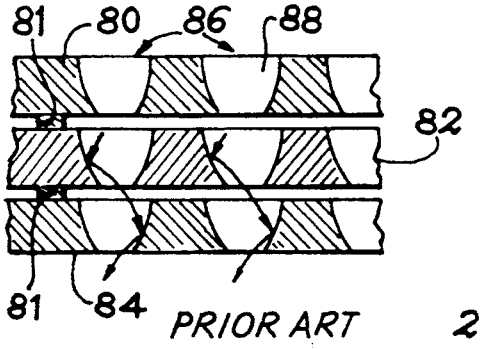
Figure 3:
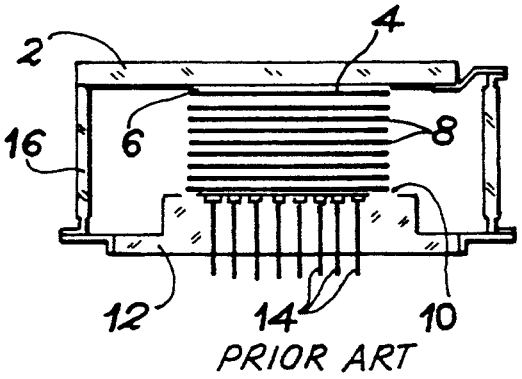
Figure 4:
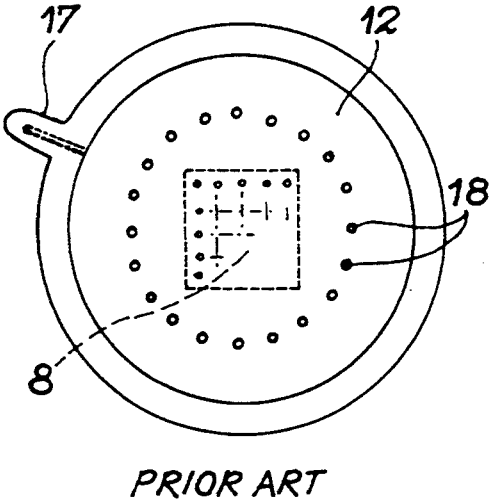
Figure 5:
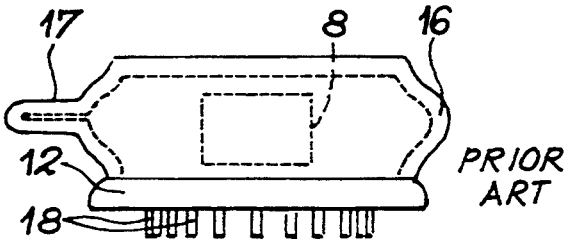
Figure 7:
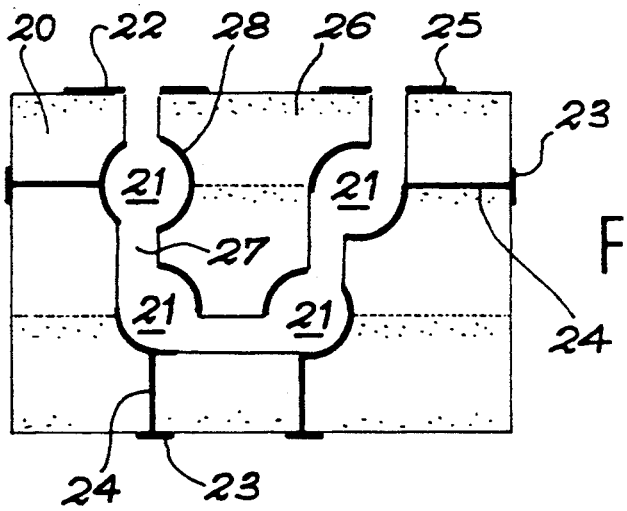

FIG. 7 shows a possible configuration of a channel in a multiplier according to the invention and more particularly in a ceramic block 20.

It is firstly possible to see the non-rectilinear shape of the channel. This results from the fact that in this case its inlet and outlet imposed by the polarization of successive cavities are located on the same upper surface 26 of the block 20. Therefore the input 22 and output 25 electrodes are located on said same surface 26. The channel is formed by a succession of several cavities 21 connected by ducts Each cavity 21 is equipped with polarization means 28, 24, 23 for raising the internal surface of each of them to a given electrical potential. The conductive walls covered with a conductive metal deposit 28 and then chemically activated constitute the multiplying zones. This metal deposit 28 is itself connected to an external electric contact 23 located on one of the surfaces of the ceramic block 20 by means of a connector 24. Each lateral contact 23 is raised to the necessary potential for the corresponding cavity to enable it to form a multiplying zone.

FIG. 7 shows that the connectors 24 are embedded in the ceramic block 20. The configuration of this type is preferably obtained by forming the ceramic block 20 through the use of ceramic sheets. The connectors 24 are then applied to one surface of said sheets during their preparation.

Figure 8:
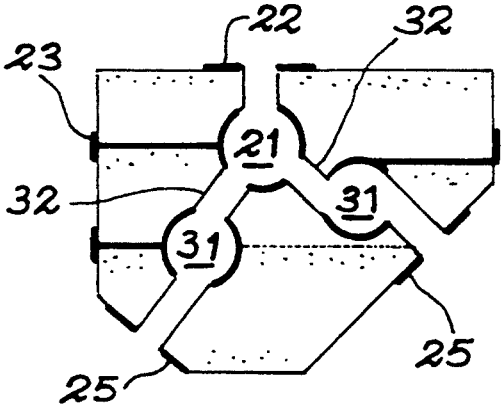

FIG. 8 shows another function of the multiplying cavities constituted by the spatial distribution of the secondary electrons. The channel is subdivided at 21 into two parts by means of two ducts 32, each leading to another cavity 31. Therefore the channel is subdivided into two and terminates with two output electrodes 25. In the case shown, these two output electrodes 25 are placed on two different faces of the ceramic block.

It is also possible to envisage the reverse situation, where at least two channel join in a cavity in order to summate the electron fluxes in the common multiplier channel. In this case each has an input electrode, but a single output electrode.

Figure 9:
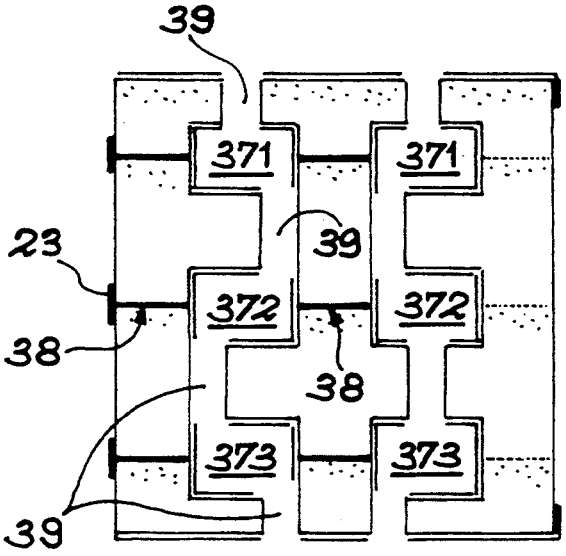

Another cavity shape in shown in FIG. 9. The cavities 371, 372, 373, as well as the ducts 39 are cylindrical resulting from the stacking of appropriately perforated sheets. For each cavity, one of the sheets forming it carries the conductive track 38 connecting it to the external contact 23.

Such a construction makes it possible to simplify the production of the ceramic block by simplifying the shapes to be made in the plates 36. All the cavities of the same stage 372 are raised to the same potential by means of conductive tracks 38 connecting to one another the conductive deposits of the cavities and to the external contact 23.

In the four examples described by FIGS. 6, 7 and 8, each successive cavity of a channel is brought to a given electrical potential, which successively increases in order to satisfy the multiplication conditions.

Figure 10:
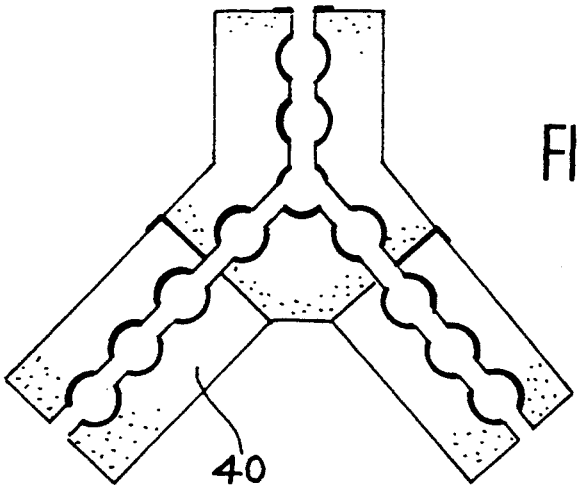

FIG. 10 is a cross-section of the already described three multipliers 40. This shows the possibility of associating the multiplying blocks with one another, thus making use of their mechanical and electrical autonomy.

Figure 11:
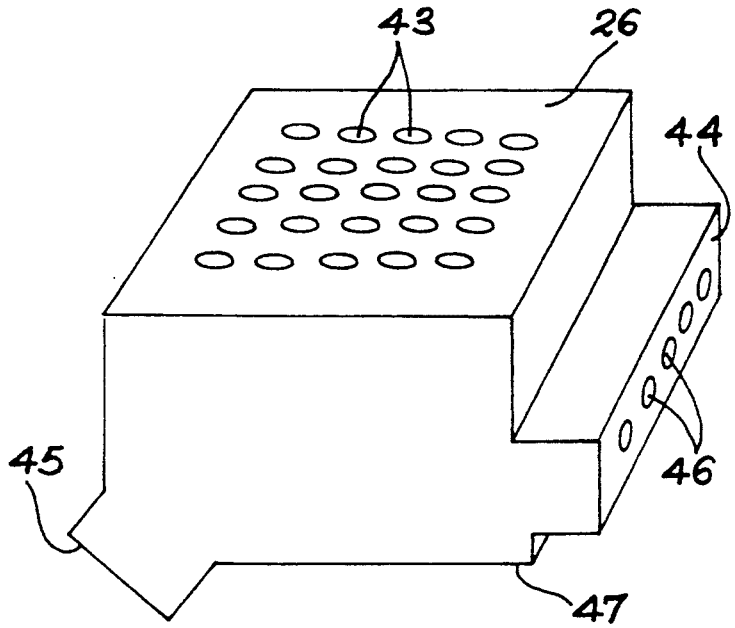

With reference to FIG. 11, it is clear that it is possible to produce a very complex, compact ceramic multiplying structure. Therefore such a structure can have on its upper surface 26 the entrance of each channel 43, but can in particular have on different surfaces 44, 45 the outlets 46 of said channels. It is very advantageous to be able to modify in space the trajectory of the channels in order to be able to orient the outlet of each of them in the direction of the elements and equipments used for the exploitation of the amplified signals. Thus, the shape of the multiplier is adapted to its intended use.

Figure 12:
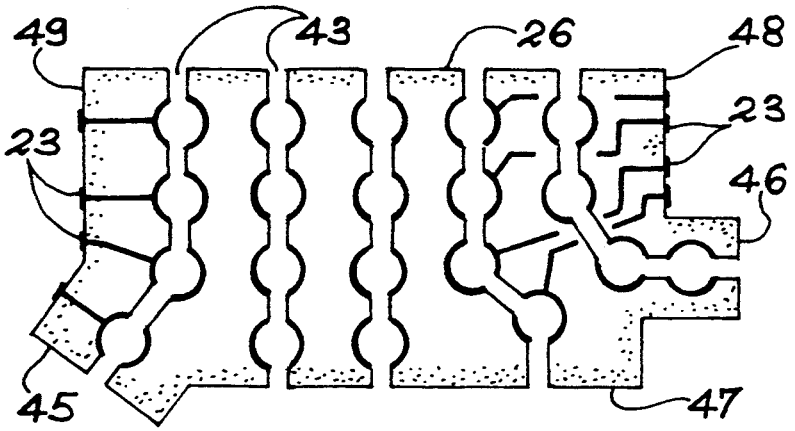

FIG. 12 shows in section such a compact ceramic structure. It can be seen that all the channels 43 have their inlet or entrance on the upper surface 26. However, the exists or outlets of these channels are located on three different surfaces 45, 46, 47.

The lateral contact 23 can be assembled on the same lateral surface 48 or 49. Thus, the cavities 21 of the channels can be raised to different potentials compared with the other cavities of the same channel, but also compared with the cavities of the same rank of other channels.

FIG. 13 shows several crude ceramic plates 51 to 56, prepared and placed above one another during stacking, whilst FIG. 14 shows them after baking. Thus, during the production of the ceramic multiplying structure according to the invention, use is made beforehand of ceramic plates which are prepared by machining using punching, drilling, etc., with a view to forming a stack for producing the multiplying structure. An example of two portions of adjacent channels is given in FIG. 13. The two first plates or sheets 51 and 52 are attached to one another. They are also perforated and each hole 57 is coated with a conductive material 58. This operation preferably takes places by screen process printing of a conductive ink linking the two opposite surfaces 59 of the two plates 51, 52, as well as to a lateral contact 23 by means of a conductor 24. The diameter of the holes 54 is relatively large with a view to forming the inner wall of the two cavities. The fourth and fifth plates 54, 55 are subject to the same procedure.

However, the third plate 53 and sixth plate 56 are individually inked on their large surface 60 around the holes 61 having a smaller diameter than the holes 57 of the other plates. The position of these holes 61 corresponds to that of the holes 57 of other plates. Most of the inner wall of the holes 61 is insulating, because it is made from ceramic.

FIG. 14 shows the stack of six plates. It can be seen that the third and sixth plates 53, 56 are positioned relative to the two assemblies constituted by the first and second on the one hand and fourth and fifth on the other, so as to be offset. In other words, the holes 61 of the third and sixth plates 53, 56 are offset relative to the holes 57 of the four other plates. By bringing about correspondence of part of the inner surfaces of these holes 57, 61, it is possible to form cavities 62 and duct fragments 63 in the same way as in the embodiment of FIG. 9.

The aim of this example is to demonstrate the feasibility of different channels, cavities, walls and conductive tracks described hereinbefore using presently available means in the field of multilayer ceramics an in no way limiting the shapes or arrangements of the constituent elements of the compact multipliers.

FIG. 15 shows the side of a multiplying structure as obtained with the process of FIGS. 13 and 14. Thus, on the lateral face 64 of said structure, it is possible to see several lateral contacts: 230 polarizing the entrance of the channels, 231 the median stage and 232 the exit or output electrode.

For this purpose the stages are positioned one below the other, all the lateral connectors 230, 231, 232 being displaced and being more easily connectable by a resistive deposit establishing the distribution of the potentials as soon as the contact 230 is raised to a voltage and 232 to earth in exemplified manner. At the end of this phase there is a rigid, compact multiplying structure including in the mass insulated conductive cavities polarizable by external mass.

By electrodeposition of any other procedure, it is also possible to cover the conductive areas with one or more appropriate metals able to receive surface treatments for increasing the secondary emission phenomenon.

The distribution of the different potentials on the lateral contacts 23 can take place by means of a resistive ink. The adjustment of the values can take place after baking by volatilization of the ink under the impacts of a laser beam.

FIG. 16 shows a photomultiplier obtained by means of a multiplying structure produced with the process of the invention. Such a photomultiplier comprises an entrance shielding window 90 carrying on its inner face a photocathode 92, which will emit photoelectrons under the action of light. These electrons, drained towards the entrance of the channels will be multiplied during the progression of the electron impacts in the multiplier.

The exiting electron flux is collected by internal electrodes 96 connected to the external contacts 91 by conductive tracks 95. All these elements are included in the base 98 made from multilayer ceramic material.

Through the latter the signals pass out onto the external contacts 91 connected to the output electrode 96. The base 98 is preferably made from multilayer ceramic, in order to eliminate the connecting pins to the advantage of the surface contacts 91. Thus, the latter constitute robust connecting elements having small overall dimensions and compatible with microelectronics standards. Moreover, such a base and the multiplier have a total light opacity.

As has been shown, such a compact multiplying structure can simply be placed between a shield window carrying a photocathode and a signal extracting base.

ADVANTAGES OF THE INVENTION

The production process according to the invention consequently provides a compact object, which is mechanically, vacuum and electrically autonomous. Therefore it eliminates all the maintenance and centring elements of the metal plates constituting the multiplying stages in the prior art processes. It eliminates all the cumbersome elements for the polarization of the stages. It eliminates the glass or metal envelope, whose only function is to maintain the vacuum. It eliminates all the differential expansion problems between the conductive and insulating parts, which reduce and often destroy the hermetic seal of the enclosures. It offers an object made from a high quality material, i.e., ceramics, particularly with respect to ultra-high vacuum. From the mechanical standpoint it offers increased precision and excellent surface states. It offers considerable dimensional possibilities and therefore permits a considerable increase in the number of channels. It enables the number of stages to be increased without significantly increasing production costs.

The object produced behaves like a component to be inserted in an instrument chain and is free from any protection against the ambient atmosphere. Within the scope of applying the invention to the production of multichannel photomultipliers, there are several advantages for manufacturers. The activation of matrixes for increasing the secondary emission can take place independently of the production of the photocathode, the final assembly and the sealing of the tube. The control of the gain of each channel can be made prior to the assembly to the output base, so as to only combine components having recognized performance characteristics.

Final assembly takes place by the transfer method making it possible to choose the nature of the shield window and the photocathode, together with the level of its emissivity, prior to the final sealing of the tube.

This separation of functions makes it possible to produce several tubes at once and reduces the failure rate during manufacture.

The following advantages are also obtained for users when employing these photomultipliers. The operation of the multichannel photomultiplier merely involves establishing the potentials of the cathode and the earth at the ends of the tube. The juxtaposing of tubes makes it possible to cover large photo-sensitive surfaces, whilst minimizing dead areas. The output of the signals does not interfere with the high voltage supplies of the tubes and makes it possible to produce a homogeneous electronic platform for their acquisition. The resulting assembly is very compact from the height standpoint, being approximately 15 to 20 mm, as a function of the number of stages.

The multiplying structure according to the invention is not limited to its aforementioned application to photomultipliers.

Without wishing to give an exhaustive list of potential uses, where considerable improvements can be made in the manner described hereinbefore, the list provided gives the composition of assemblies satisfying the corresponding explanations.

Within the scope of a multichannel light intensifier, the initial particle source is a photocathode, the ceramic multiplier has a permanent polarization of the stages and the receiver is an internal phosphorescent screen associated with a plurality of photodetectors or a charge transfer device.

In the application to a detector for mass spectrometry, the source is a target bombarded by ions and supplying secondary electrons, the ceramic multiplier having a permanent polarization of these stages and the receiver is constituted by output electrodes associated with operating electronics.

For the analysis of surfaces, dosimetry by exo-emission, the source is a surface or a deposit on a surface supplying a spontaneous or stimulated electron exo-emission, there is once again the ceramic multiplier with the permanent polarization of the stages and output electrodes connected to operating electronics.

For measuring or checking vacuum and ultra-high vacuum, the source results from an excitation of the molecules and residual atoms of a vacuum enclosure, the ceramic multiplier having a permanent polarization of the stages associated with a magnetic field and once again use is made of output electrodes with operating electronics.

In the case of a time, analog correlation of events, the source is one of the aforementioned sources, the multiplier is of a ceramic material with a conditional supply of the stages. The output is constituted by electrodes, each associated with operating electronics.

Finally, for increasing the brightness of electron injectors, use is made of one of the aforementioned sources, the ceramic multiplier with the permanent polarization of the stages and an electronic optics for adapting the transfer of the electron flux to the output electron optical stage.

Hitherto our intention was to use the walls of the cavities and targets for increasing the electron population and to use the electron optical properties imposed by the shape and arrangement of the metal cavities. If the target function fulfilled by the walls is not eliminated avoiding the electrons striking the same, these appropriately dimensioned and centred cavities behave as juxtaposed electrostatic lenses. This ceramic structure becomes as "electrostatic multilens" benefitting from all the technological advantages described hereinbefore and conditioning the electrons so that they are present in optimum manner at the input of the following electrostatic optics.

I claim:

1. Compact, secondary emission electron multiplying structure having a plurality of multiplying channels (43,), said multiplying structure comprising a tight, compact, insulating ceramic block, said ceramic block having distributed therein three-dimensional form cavities (21, 31, 33, 34, 35, 37, 41) having conductive walls formed from a conductive deposit (28), said cavities being appropriately activated and interconnected by a connecting duct (63) permitting the transit of the amplified electron flux, as well as the polarization means of said cavities, said multiplying structure being a high temperature sintered stack of ceramic plates or sheets (51 to 56), originally in a crude state, whereof each has been previously perforated and machined in order to create connecting ducts (60) and cavities (21, 31, 33, 24, 35, 37, 41), the polarization means being constituted by conductive walls on the surface of the cavities and conductive tracks (24) on a surface (59) of each ceramic plate in order to connect each cavity to external electrical lateral contacts (23).

2. Structure according to claim 1, characterized in that the cavities (21, 31, 33, 34, 35, 37, 41) are spatially distributed in three-dimensional form, particularly for the cavity (21, 31) of the same channel (43).

3. Structure according to claim 2, characterized in that each of several output faces (45, 46, 47) having an output electrode (96) placed thereon, where each of said output faces has a surface that leads to at least one channel (43).

4. Structure according to claim 1, characterized in that several of the channels have at lest one intersection point such that they communicate with one another.

5. Structure according to claim 1, characterized in that at least one of said channels is subdivided into at least two channel branches (32).

6. Structure according to claim 1, characterized in that at least two channels join in a cavity in order to summate electron fluxes in a common multiplying channel.

7. Structure according to claim 1, characterized in that several successive cavities (41) of said three dimensional form cavities are polarized to the same voltage being connected to the same lateral contact (23) for forming a multicellular multiplier stage 40.

8. Photomultiplier having a multiplying structure according to claim 1 and a photocathode (92) placed at a first end of each said channel for receiving the light pulses and for transforming them into electronic pulses in said channels (43), at least one output electrode (96) for sampling amplified pulses and positioned at the second end of each channel (43) and a base (98), also constituted by ceramic 9. A process for the production of an electron multiplying structure, comprising the following steps:

machining ceramic plates (51, 52, 53, 54, 55, 56) to form said cavities (21, 31, 33, 34, 35, 37, 41) and channels (43), said ceramic plates being in a crude state;

inking with conductive ink areas intended to form the cavities and conductive tracks (24) connecting them to one another, and to a lateral external contact (23); and stacking the thus prepared plates, baking the stack, depositing on conductive areas of the cavities a material of a high coefficient of secondary emission, deposition on said external contacts (23) of metals ensuring an excellent ohmic contact and activation of the multiplying structure by physicochemical processes.

* * * * *

UNITED STATES PATENT AND TRADEMARK OFFICE

CERTIFICATE OF CORRECTION

| | | |
|---|---|---|
| PATENT NO. | : | 5,367,218 |
| DATED | : | November 22, 1994 |
| INVENTOR(S) | : | Georges Comby |

It is certified that an error appears in the above-identified patent and that said Letters Patent is hereby corrected as shown below:

On the title page item [73] should read as follows:

[73] Assignee: Commissariat a l'Energie Atomique

Signed and Sealed this

Sixteenth Day of May, 1995

*Attest:*

Bruce Lehman

BRUCE LEHMAN

*Attesting Officer*

*Commissioner of Patents and Trademarks*